United States Patent [19]

Northway et al.

[11] 4,261,110

[45] Apr. 14, 1981

[54] VERTICAL CONTINUOUS FEED TIMBER KILN

[75] Inventors: Richard L. Northway, Ascot Vale; Lee S. Barker, Hawthorn, both of Australia

[73] Assignee: Commonwealth Scientific and Industrial Research Organization, Campbell, Australia

[21] Appl. No.: 10,045

[22] Filed: Feb. 6, 1979

[30] Foreign Application Priority Data

Feb. 9, 1978 [AU] Australia ..... PD3313

[51] Int. Cl.³ ..... F26B 7/00

[52] U.S. Cl. ..... 34/13.4; 34/28; 34/31; 34/216; 34/217; 432/11; 432/125

[58] Field of Search ..... 34/13.4, 13.8, 16.5, 34/28, 31, 216, 217, 236; 432/11, 125

[56] References Cited

U.S. PATENT DOCUMENTS 1,420,296 6/1922 Thelen ..... 34/216 X

FOREIGN PATENT DOCUMENTS 438377 11/1935 United Kingdom ..... 432/125

*Primary Examiner*—John J. Camby

*Attorney, Agent, or Firm*—Cushman, Darby & Cushman

[57] ABSTRACT

A method and apparatus for drying timber stacked in a vertical kiln in spaced apart layers. The timber being continuously moved from the top to the bottom of the stack to be passed through various stages of treatment including a drying in which the timber is subjected to reverse process of heated air. The bottom layer is periodically removed from the stack and a new green layer added to the top.

12 Claims, 10 Drawing Figures

115
113
131
130
120
160
140
161
160

115
113
131
130
120
160
140
161

115
131
130
161
120
160
140
113
160

150
131
115
130
120
161
160
140
113
160

131
115
115
150
130
161
160
140
113
160
120

115
113
131
161
120
140
160

VERTICAL CONTINUOUS FEED TIMBER KILN

This invention relates to a process and apparatus for drying timber.

The term "timber" as used throughout this specification is not meant to include man-made materials such as hardboard, particle board or other wood based panels.

It is customary to treat timber, particularly timber to be used for structural or other building purposes, by reducing the moisture content to a level very much below that prevailing in a growing tree. This is in order to ensure good dimensional stability and to induce a relatively uniform moisture distribution within the timber. Thus, the moisture content might be reduced to 12% for timber to be used as flooring, or to 12–15% for timber to be used as framing timber, as compared with the moisture content of a typical green log of 100%, the precise desired moisture content being determined in accordance with the use to which the timber is to be put and the environment in which it is to be placed.

Reduction of moisture content can be effected, subsequent to sawing to the approximate dimensions required of the timber as it is to be used, by exposing it to atmospheric conditions for a relatively long period of time. This process has the disadvantage in that it is prolonged. It is therefore common practice to accelerate the drying process by placing the timber in heated kilns in which the temperature and relative humidity can be controlled to enable establishment of a repeatable "drying schedule" which will produce the desired final moisture content in the finished product. Timber is normally stacked in these kilns in layers, each layer consisting of a number of side-by-side pieces of timber and the layers being separated by spacing pieces, called "stickers". This mode of stacking permits free circulation of air around the timber and accelerates the drying process. Restraining weights are usually applied to the top of such stacks to limit distortion which frequently occurs during drying timber such as softwood.

Customarily, heated air is circulated through the kilns to effect heating. When treating softwood such as pinus spp. the air is, in normal practice, heated to a temperature of the order of 85°–90° C. and passed across the timber at a velocity of the order of 2.5–3.0 meters per second. The air may, in accordance with such practice, be of the order of 10°–20° C. wet bulb depression and of relatively high humidity. Under such conditions one inch thick timber might take some 36–48 hours to process if subsequent time after drying for a high humidity after treatment is taken into account, and two inch thick timber might require some 72–96 hours for treatment. Although it has long been recognised that times of this order are still longer than might be desired from a production viewpoint, it has hitherto been considered that any attempt to accelerate drying by using heated air of temperatures higher than are customary would lead to excessive drying distortion in the finished wood.

Not only does conventional kiln drying take a very long time, but it is frequently desirable to subject the timber to other treatments such as steaming, which has the effect of relaxing stresses caused by a moisture gradient that is set up within the timber during drying. By spraying steam into a chamber, the steam condenses onto the outer surface of the timber, and "case hardening" is eliminated by redistributing the moisture to relax the stresses within the timber. It is therefore frequently desirable to transfer the timber from the kiln to a steaming chamber, which operation involves extensive labour and time.

In conventional compartment type kilns timber is dried in a batch process with the tops of the stacks weighted throughout the process. Attempts to dry timber continuously either layer by layer or board by board have previously been thwarted by the difficulties of restraining them from warp during the process.

In our earlier Australian Pat. No. 481,539 a method and apparatus for drying timber is disclosed in which the timber is dried by passing it horizontally through a drying zone. However, it is difficult to provide means to prevent distortion of the timber during drying and the apparatus included a complicated frame in which the timber was held during drying to prevent distortion. These frames restricted the size of timber that could be dried and tended to make the apparatus bulky and expensive, as well as restricting the volume of timber that could be dried.

According to one aspect of the present invention there is provided a method of drying timber, comprising:

(a) Forming a vertical stack of timber, comprising a plurality of layers of timber spaced apart by spacing means;

(b) Sequentially moving said layers of timber from the top to the bottom of said stack; and (c) Circulating heated air past at least a portion of said stack.

Preferably said method includes directing said heated air in reversed streams past said layers of timber.

Preferably, a bottom layer of timber is periodically removed from the base of the stack and a new green layer is added to the top of the stack. The method may also include passing the timber sequentially through a heating zone in which the layers are subjected to heated air streams, a cooling zone in which the layers are open to atmosphere, and a zone of high humidity in which steam is condensed onto the layers of timber.

In a preferred embodiment the heating zone is positioned below the top of the stack at a position sufficiently below the top so that the weight of the timber and spacing means above that position prevents distortion within the heating zone. In a preferred embodiment the method comprises supporting the stack of timber on a support platform assembly vertically displaceable by means of jacks, lowering the support assembly, displacing a stack-support mechanism so that tynes of said mechanism locate between the spacing means to support the stack of timber via the penultimate base layer of timber, and removing the bottom layer of timber and spacing means below said tynes resting on said support platform away from said stack.

In accordance with a further aspect of the present invention there is provided apparatus for drying timber, arranged in a vertical stack formed by a plurality of spaced apart layers of timber, the apparatus comprising means arranged to support the stack and to sequentially move each of said layers from the top of the stack to the bottom, and means to direct the heated air in reversed streams past the layers of timber at a portion of the stack.

The apparatus may also include means to periodically place a new layer of timber onto the top of the stack with spacing means positioned between the new layer and the penultimate layer.

In a preferred embodiment the support means includes means to periodically eject a layer of timber from the base of the stack so the remaining layers all move down the stack by one layer, said means comprising a platform assembly vertically displaceable to support the base of the stack, a secondary support mechanism displaceable to locate between adjacent layers of timber to support the stack and thereby allow at least one layer of timber below said mechanism to be removed. Preferably, a conveyor is positioned below said platform assembly so that as the assembly is lowered the layer of timber rests on the conveyor so that the conveyor can transport said layer away from the base of the stack. The support platform assembly is preferably displaced by the use of jacks. The secondary support mechanism may include a plurality of tynes which are arranged, when supporting the stack, to extend between adjacent spacers.

Preferably, means to circulate heated air comprises at least one fan coupled to ducting, the ducting being arranged to direct the air past the layers of timber. The ducting also being designed to reverse the direction of the stream of hot air so that as the stack passes through the apparatus the timber is sequentially subjected to currents of hot air from opposed directions.

The apparatus preferably includes a plurality of zones sequentially spaced from the top of the stack and commencing with a preloading zone, a drying zone in which the timber is subjected to heated air, a coolng zone in which the layers of timber are open to atmosphere, a high humidity zone in which layers of timber are subjected to an air, water vapour mixture created by injecting steam into the space and finally an ejection zone in which the layers of timber are removed from the bottom of the stack.

One embodiment of the present invention will now be described by way of example only, with reference to the accompanying drawings in which.

Figure 5:
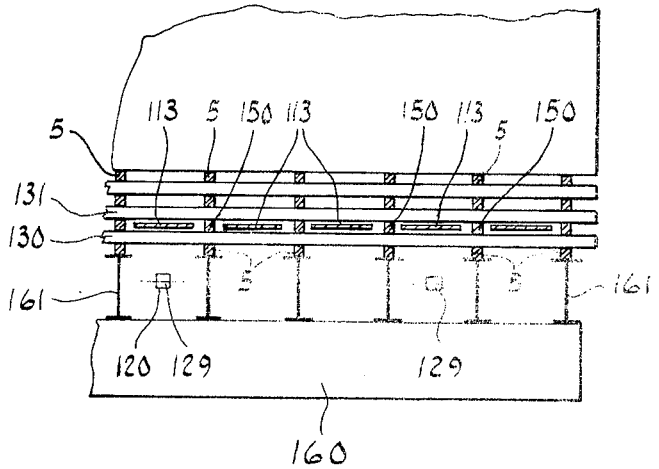
Figures 4A, 4B, 4C, 4D, 4E, 4F:
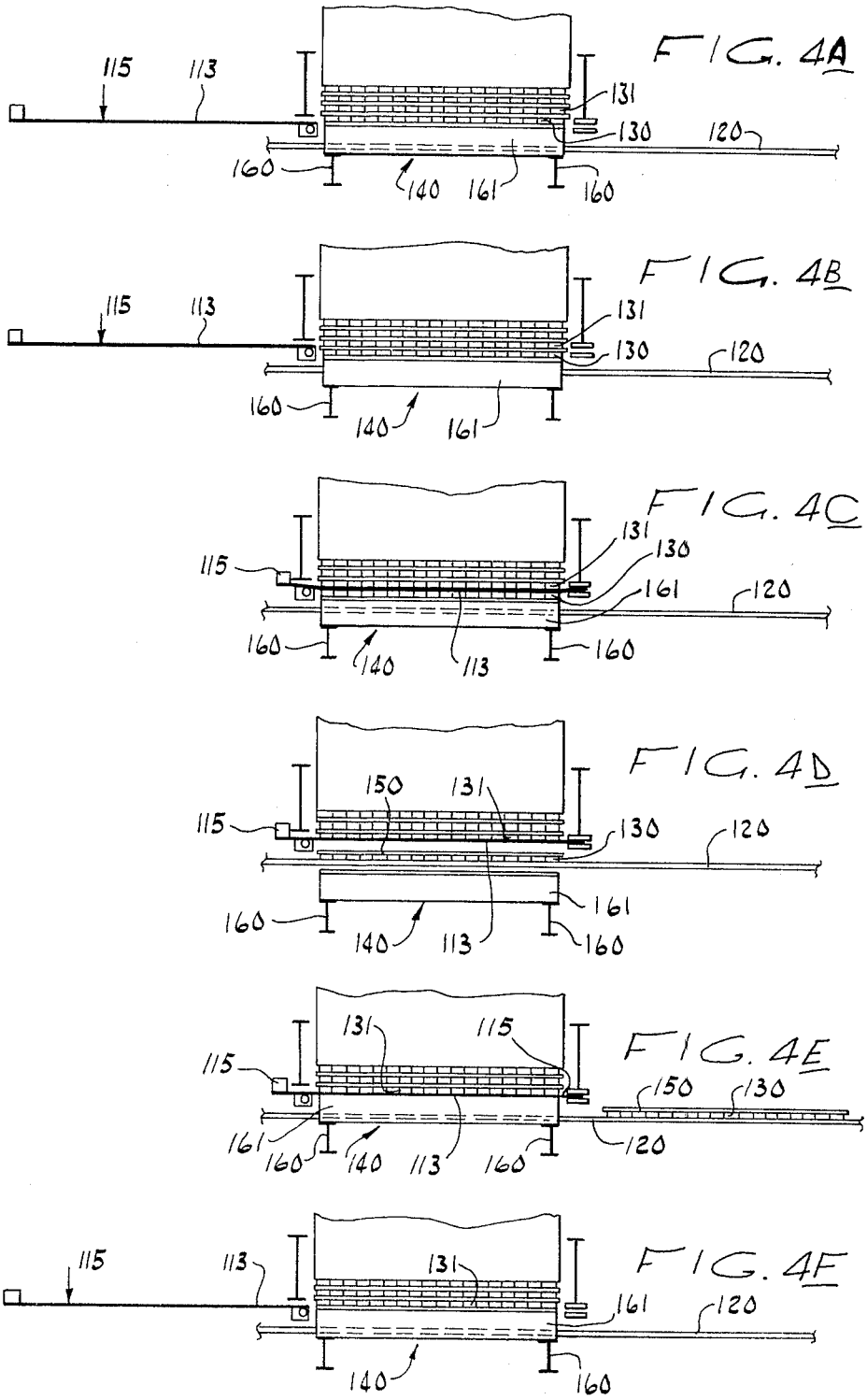

FIGS. 4A–F are illustrative views of the base of a stack of timber illustrating a method of ejection of a layer of timber; and FIG. 5 is a detailed view of part of the base of the stack shown in FIG. 4C.

Figure 1:
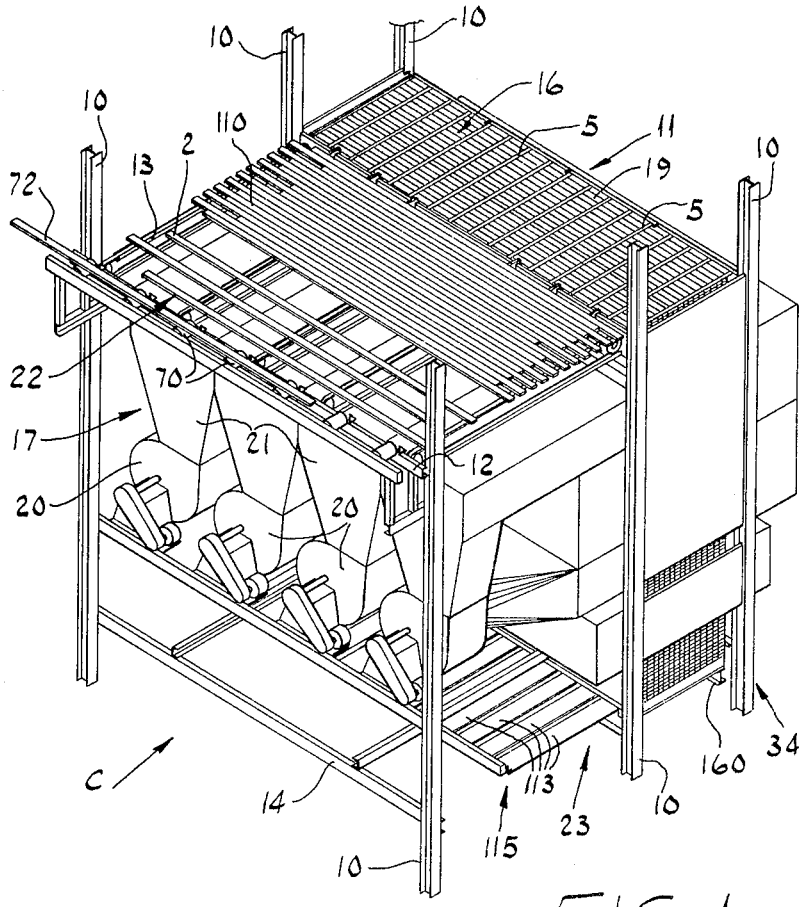
FIG. 1 is a perspective view of apparatus for drying timber.
Figure 2:
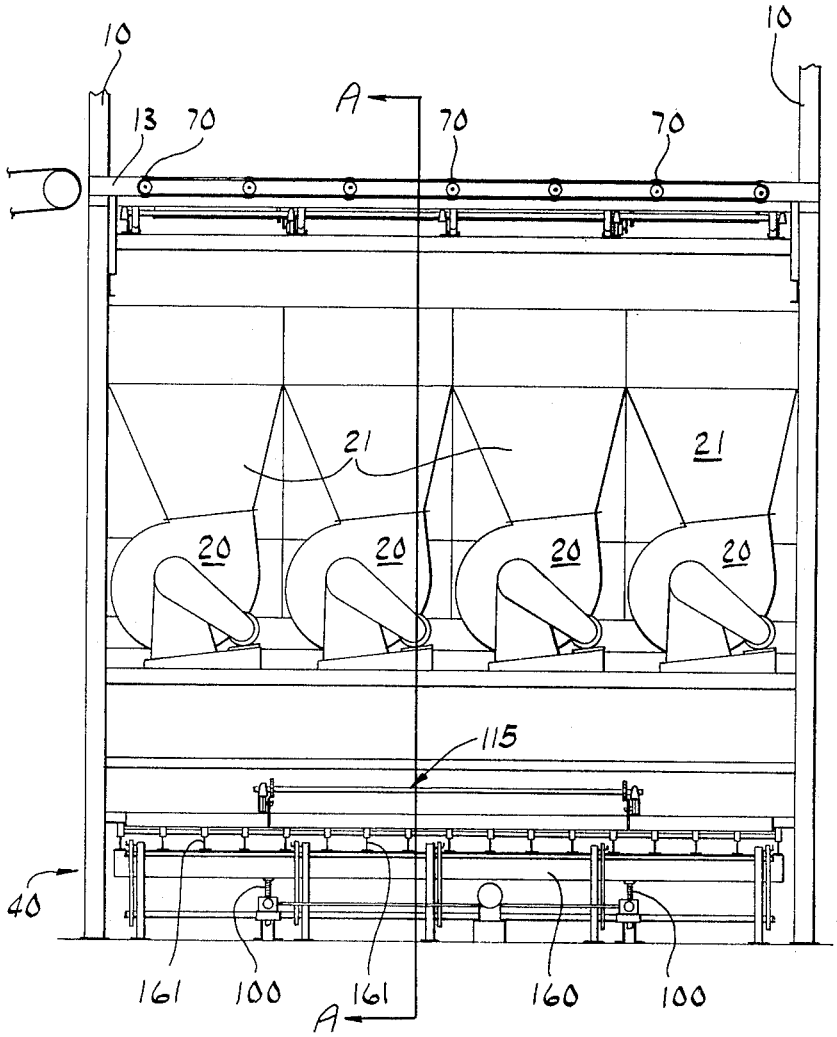
FIG. 2 is an end-on view of the apparatus of FIG. 1 viewed in the direction of the arrow C.
Figure 3:
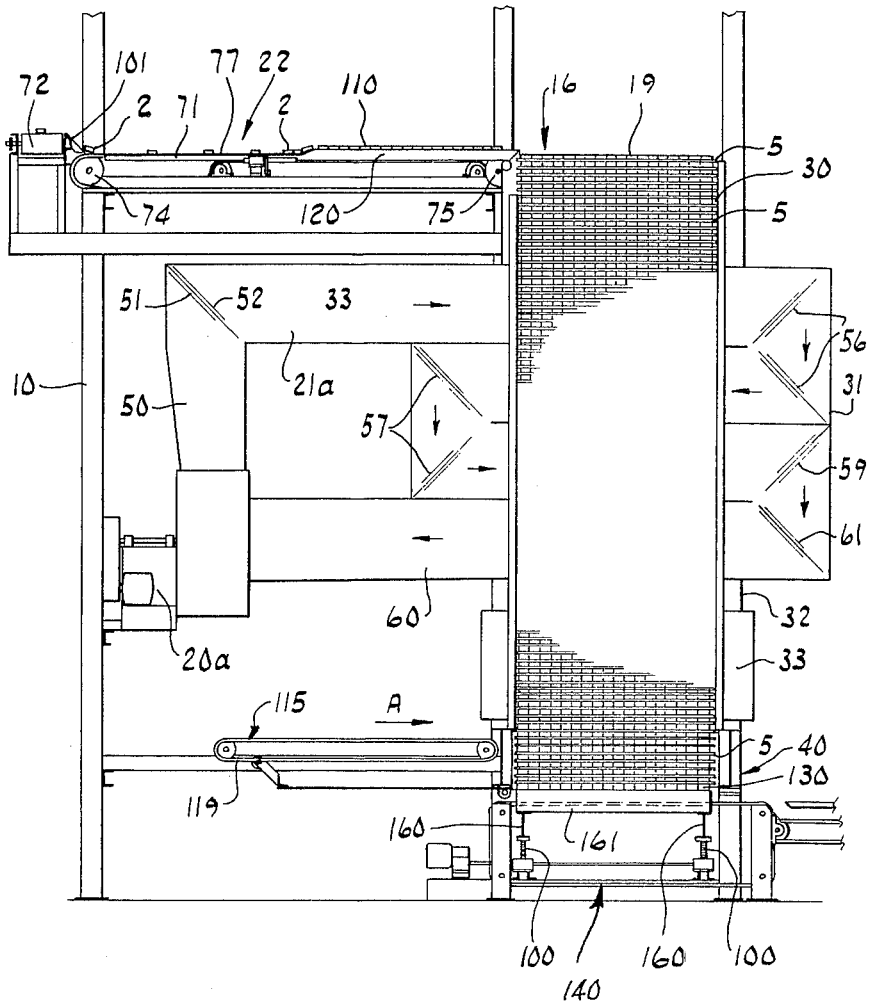
FIG. 3 is a section taken along the lines A—A of FIG. 2.

Apparatus for drying timber as illustrated in FIGS. 1–3 comprises a vertical kiln supported by a frame comprising six vertically extending "I" girders 10 which connect the floor of the room in which the timber is dried to the ceiling and thereby provide a very firm and rigid support for the kiln. However, in an alternative arrangement, the whole apparatus could be free standing. At an upper end 11 of the girders a platform is provided by transversely extending girders 12 and 13, this platform constituting the timber in-feed end of the kiln. Adjacent the lower end of the girders 10 is a similar platform constituted by cross members 14 and this platform constitutes the ejection end 34 of the kiln. Four of the vertical girders define a zone 16 in which the timber is stacked during drying. The remaining space 17 defined by the framework of girders houses fans 20 and air dicts 21, together with a feeding conveyor system 22 and ejection means 23.

The stack 19 of timber to be dried comprises spaced layers of timber, each layer comprising a plurality of strips of initially green timber approximately four to six meters in length and cut to a substantially constant thickness of typically between twenty to fifty millimeters. These strips are laid in a side-by-side relationship with their longitudinal axis parallel to the longest side of the stack, as shown in FIG. 1. The stack is supported at the base by a vertically displaceable support platform assembly 140. Each layer is spaced by the use of wooden spacers 5, or stickers 5, which are laid in a spaced-apart manner on a layer of timber transversely to the longitudinal axis of the strips. A plurality of stickers are equally spaced on top of the adjacent layer and have the effect of spacing the layers of timber strips by about twenty to thirty millimeters. The next layer of strips is then laid on top of the spacers until the stack comprises a six meter high stack of timber with a layer of spacers between each layer producing, in the embodiment illustrated in FIGS. 1 to 3, a stack comprising ninety-four layers of timber.

In FIG. 3 the various operative zones within the stack are illustrated. At the top of the stack there is a preloading zone 30 which extends for approximately one meter and in which green strips of timber are stacked and guided in the stack by the columns 10. The preloading zone 30 merges into the drying zone 31 which extends for three meters down the stack and terminates in a cooling zone 32 which adjoins a steaming zone 33. The cooling zone, including the steaming zone, extends for about one and a half meters. The steaming zone merges into an ejection zone approximately one meter in length terminating in the support platform assembly 140.

The arrangement of the drying kiln is such that the bottom layer of dried timber is ejected by the ejection means every three to ten minutes, depending on the speed at which the apparatus is working and as the bottom layer is ejected the whole stack moves down one layer and a new layer is added at the top. In this way the timber passes from the top to the bottom of the stack to be ejected in a normal operation after about seven hours.

The timber is dried within the drying zone 31 by a current of hot air which is driven by four electrical fans 20 which are connected to ducting 21 to drive air heated by a gas burner (not shown) through the drying zone. As shown in FIG. 3, which is a section taken along the lines A—A of FIG. 2 illustrating the fan 20A and its associated duct 21A, the fan drives the air up a duct 50 around a corner 51 via baffles 52, along a horizontally extending upper pipe 33, through an upper region of the drying zone 31 past the adjacent layers of timber. The air current is then turned by baffles 56 and 57 to continue along a horizontal path in a reverse direction through a lower group of layers of timber and finally to be reversed yet again in a still lower passageway 60 by baffles 59 and 61 before returning to the air supply to be reheated. It can be therefore seen that within the drying zone 31 the hot air current passes through the stack of timber and is constantly reversed to dry the timber from two opposite directions. This ensures even efficient drying of the whole stack of timber within the drying zone. The ducting associated with each of the fans operates in the same manner to ensure that the drying zone operates across the whole length of the stack. It is understood that many other variations of ducting are acceptable to provide the opposed streams of hot air and that subsidiary heating members may be provided within the ducting to assist drying of the timber The timber, on leaving the drying zone, is then allowed to cool in the cooling zone 32 which can either be an area of the stack open to atmosphere or one subjected to a forced cool draught. The timber is subsequently exposed to conditions which induce stress relaxation and moisture redistribution created by introducing steam to a high humidity zone 33, to finally reach the ejection end 34 of the kiln.

At the infeed end 22 of the kiln strips of timber are initially fed into the upper platform 13 of the structure via an infeed conveyor 72 comprising a plurality of spaced-apart rollers 70 until the end of each strip abuts a stop at the edge of the framework. A strip is then transferred to a conveyor system 71 illustrated in FIG. 3, comprising a plurality of spaced-apart belts 77 driven by a pair of pulleys 74 and 75, the piece of timber 2 sliding down a slope 101 from the infeed conveyor system 72 to land on the belts 77. The belts then transfer each strip towards the stacking zone 16 until it moves into abutting contact with other strips 110 forming the next layer awaiting transfer to the stack 19. The strips are crowded into edge-to-edge abutment against fixed stops by the conveyor 77 and then a number of lifting bars 120 extending across the frame lift a layer of the boards clear of the stops so that they can be automatically transferred to the stack 19. In the meantime a layer of spacers 5, or stickers 5, has been positioned on the adjacent layer in the stack so that the new layer can be positioned thereon. The stickers may be positioned by hand or, alternatively, an automatic device may be used to position the stickers on the adjacent layer of timber. Because the strips of timber tend to be of varying length the infeed conveyor 72 is provided with "kick-off" (not shown) means at each end which are alternatively activated by opposite ends of the strips to transfer the strips from the rollers 70 to the belts 77. In this way it is ensured that long and short strips are uniformly distributed within the layers abutting alternate ends of the layer so that the layers are evenly supported in the stack as shown in FIG. 1.

At the other end of the stack the ejection means 23 is provided to periodically remove the bottommost layer of timber and stickers 5 from the stack. The ejection means comprises the support platform assembly 140 which extends across the width and length of the stack and is displaceable vertically by screwjacks 100 illustrated in FIG. 3 to abut the base of the bottom layer 130 of the stack of timber. Although screwjacks are illustrated in FIG. 3, other jacking means such as hydraulic or scissor jacks may be used. As shown in FIGS. 2, 4 and 5, the support platform assembly 140 consists of a spaced pair of longitudinal beams 160 which extend along the length of each side of the stack and a plurality of spaced transversely extending bridging "I" beams 161 which extend transversely from the longitudinal beams 160 so that the "I" beams 161 are directly beneath the spacers or stickers 5. An outfeed conveyor 120 comprising a pair of spaced driving chains 129 (FIG. 5) is arranged to run parallel and between two pairs of the transverse "I" beams 161.

The operation of ejection means is illustrated with reference to FIGS. 4A to 4F. During operation of the apparatus the support platform assembly 140 abuts the bottom layer 130 until a new layer of green timber is added to the top of the stack 19 (FIG. 4A). At this stage the whole stack 19 is lowered by lowering the support platform assembly 140 by use of the jacks 100 (FIG. 4B).

A stack support mechanism 115 comprising a longitudinal beam 112 having secured thereto a plurality of spaced-apart tynes 113 (FIG. 1) to extend across the width of the stack is arranged to be horizontally driven by a conventional driving mechanism 119 in the direction of the arrow A in FIG. 3, so that the tynes 113 locate between the layers 130 and a layer 131 of timber above the lowest layer 130, with each tyne between a pair of adjacent stickers (FIG. 4C). The location of the tynes 113 between the stickers 5 is shown in detail in FIG. 5. In this position the stack support mechanism 115 supports the stack and the platform assembly 140 can be lowered, thereby allowing the bottom layer 130 of boards and stickers 150 to drop onto the chains 129 of the outfeed conveyor 120 which transports the dry boards and stickers away from the kiln (FIGS. 4D and E). The platform assembly 140 then rises to support the stack 19 and the stack support mechanism 115 is removed by moving it horizontally in the reverse direction of the arrow A (FIG. 4F). The support platform assembly 140 then continues to take the weight of the stack until at the upper end a new green layer is deposited and the cycle repeats itself with layer 131 becoming the bottom layer which is to be removed.

The ejection means described above can also be reversed to load the apparatus with timber and stickers. Each layer of timber and stickers can be added to the bottom of the apparatus by simple reversal of the procedures described above. The layers can be fed in one by one until the stack is full. At this point, the operation and direction of the means is reversed and the drying, cooling and humidifying takes place in the usual manner. Since the bottom layers of timber, if green, would not be dried they could be recycled or alternatively the apparatus can be fed with timber in a varying state of dryness, the drier timber being positioned at the bottom of the stack.

To operate satisfactorily, it is understood that the apparatus must also include a number of control mechanisms to ensure synchronous operation of the machine such as limit switches, hydraulic mechanisms, and timing mechanisms to ensure that each phase of the operation of the apparatus starts and finishes at the correct time before the next phase comes into operation. It is understood from the spirit of this invention that the apparatus could include any conventional type of control mechanism which would be used in an automated plant of the kind described above. The control mechanism is also arranged so that the speed of the machine can be varied to increase or decrease the frequency in which a bottom layer of dried timber is removed and replaced by a new green layer on the top of the stack. In a normal situation, the bottom layer of timber is removed every three to ten minutes depending on the drying speed that is selected. The apparatus may also include means to vary the temperature and velocity of the circulating hot air. Furthermore, the velocity, temperature and relative humidity of the air and speed of movement of the layers of timber may be monitored to allow an operator to vary any one of a number of variable parameters as desired.

To illustrate the operation and advantages of the method and apparatus described above there follows hereunder two examples of a drying method utilizing an apparatus designed to simulate the conditions which the timber would experience when used in a vertical kiln of the kind described above.

EXAMPLE 1

One hundred and thirty-two *Pinus radiata* boards, 42 mm × 102 mm in cross section and 3 m long were dried in an apparatus designed to simulate the conditions which such material would experience in the vertical continuous feed kiln.

The boards were made up into a stack consisting of six layers of twenty-two boards, separated by 25 mm thick stickers on a rigid steel base frame. A second steel frame was placed on the stack and hydraulic cylinders attached to it were connected to rods passing through the stack and attached to the base frame. Hydraulic pressure in the cylinders exerted a compressive load on the stack. This load was increased during the seasoning cycle in such a manner as to simulate the increasing load experienced by an element of the stack in the vertical continuous feed kiln as it passed downwards through the kiln.

In this test the tunnel kiln was equipped with a single natural gas burner so that the direction of air flow was not reversible. In order to reverse the direction of flow through the stack, midway through the drying the stack assembly was removed, turned through 180° about a vertical axis and replaced in the kiln. Air velocity through the stack was 10 m/s. The temperature of the circulating air reached 120° C. in half an hour, 150° C. in two hours and 180° C. in three and three-quarter hours. Drying time was four hours. At the end of the drying phase the stack assembly was removed from the kiln, the stack allowed to cool for one and a half hours and then steamed for one hour. Steaming was effected by enclosing the sides and ends of the stack assembly with panels containing steam inlets.

The average initial moisture content of the boards was 67%, with the individual pieces varying from 30% to 173%. Final average moisture content was 11%.

The level of distortion in the dried boards was extremely low, much lower than that in similar boards dried in conventional processes or in earlier tests with a prototype horizontal continuous kiln.

EXAMPLE 2

One hundred and eight boards of *Pinus radiata* were stacked into 6 layers of 18 boards, but otherwise treated in a similar manner to Example 1.

The tunnel kiln was made reversible by installing a second, larger gas burner; by reversing the fans and changing burners, reversal air flow was made three times during the drying phase. After each reversal the temperature of the air entering the stack was made approximately equal to the temperature of the air exiting the stack before reversal. This was done to simulate no reheating between the four passes of air through the stack in the vertical kiln design.

| | Entering Air Temperature | Leaving Air Temperature |
|---|---|---|
| After heating for ½ hr | 174° C. | 131° C. |
| Before first reversal | 197° C. | 153° C. |
| Before second reversal | 165° C. | 140° C. |
| Before third reversal | 126° C. | 118° C. |
| Final conditions | 126° C. | 119° C. |

After drying for 3¾ hours the stack of timber was cooled for ½ hours with a forced draught of ambient air and then steamed for one hour. The hydraulic loading system was used to increase the load on the stack progressively until the stack had cooled for one hour after steaming when the load was completely removed.

The boards dried from an initial average moisture content of 77% with extremes of 26% and 165% to a final average value of 15%.

The level of distortion in the dried boards was again extremely low.

It can therefore be seen from the method and apparatus described above that green timber can be dried efficiently and quickly in a single stack as well as being subjected to steaming and cooling, thereby allowing layers of completely processed timber to be removed from the base of the stack. In other high temperature cooling kilns the timber has to be dried in batches and then moved to different areas to be steamed and cooled. Furthermore, whenever a batch of timber is loaded or unloaded from such kilns much of the heat stored in the kiln to effect drying is lost and therefore fluctuation of the heat input is required to build up the temperature to the desired level at the start of the drying of each batch of timber.

The continuous feed kiln of the kind described above allows the advantages of high temperature drying to be realized without the inefficiencies inherent in a batch-type process. The timber is fed layer by layer to the top of a high stack and for each layer added to the top a layer is removed from the bottom so that the timber progressively moves downwards through the stack to be dried, cooled, steamed and then cooled again before being removed. Because the layers are continually fed to the stack there is a regular heating demand and there is not the high loss of heat that takes place every time a complete batch is removed or added to the kiln, as in contentional kilns. Furthermore, by stacking the timber layer upon layer there is no requirement for weights at the top of the stack to prevent distortion. The drying zone can be positioned at a certain distance below the top of the stack so that there will be sufficient gravitational force caused by the green layers of timber above the drying zone to prevent those layers within the drying zone from distorting during drying. Another important advantage of the apparatus described above is that the cooling and steaming takes place within the one apparatus and there is therefore no need to transport the stacks of timber from the kiln to an area for cooling and then to a steaming or high humidity chamber. Because stickers stay in one stack throughout the whole process and for a much longer time in a conventional system, this kiln would require many fewer stickers. The reduced requirement would enable more durable material to be used with very much lower recurring costs. In the apparatus described herein, as a layer of timber is removed from the stack a layer of stickers is provided which can be placed at the top of the stack to support the green layer be being added to the top. Accordingly, only one set of stickers is required for each apparatus.

The method and apparatus of the present invention also has the advantage that because the timer is free-standing in the stack, the thickness of the layers of timber can be then varied and the apparatus will work quite satisfactorily as long as each layer is of uniform thickness. In a preferred embodiment the timber is cut to constant thickness and length but the apparatus could be used to dry two different thicknesses of timber consecutively as long as each layer is of constant thickness and the variable parameters are adjusted as the interface between thicknesses progresses down the kiln.

Accordingly, the method and apparatus of this invention provides a vastly improved and more efficient system for drying timber. The apparatus is virtually automatic and requires only one supervisory operator. Green timber can be dried quickly and efficiently to leave the kiln dried, steamed and cooled to the desired condition with a minimum of warpage of other distortion.

We claim:

1. Apparatus for drying timber comprising: a substantially vertical kiln having an interior timber-treating space of sufficient vertical height to accommodate a stack of horizontal pieces of timber arranged in layers which are vertically spaced apart; means to periodically feed at least one layer of timber to the upper end of the kiln and on to the top of a stack of timber in said interior space and means to periodically eject at least one layer of timber from the lower end of the kiln whereby each layer will move downwardly through said interior space during operation of the apparatus; a drying zone in the kiln including means for directing a current of heated drying air through said interior space in a horizontal direction and then through said space in a reverse horizontal direction at a different elevation so as to pass horizontally through a stack of timber in said space; a conditioning zone in the kiln below the drying zone, said conditioning zone including means for directing a humid air/water vapor mixture into said interior space so as to contact timber therein; means intermediate said drying zone and said conditioning zone for cooling timber in said interior space.

2. Apparatus according to claim 1 further including a pretreatment zone disposed between said upper end of said kiln and said drying zone, said pretreatment zone being of sufficient length so that a plurality of layers of the timber can be positioned within said pretreatment zone prior to entering said drying zone.

3. Apparatus according to claim 2 wherein said means to periodically eject comprises a main support platform which is adapted to support the timber stack and which is displaceable along the vertical axis of said kiln and a temporary support mechanism which is movable between a non-operative position in which it does not interfere with the timber stack and an operative position in which it is locatable between adjacent layers of the timber stack so as to thereby allow at least one layer below said timber support mechanism to be displaced from the timber stack.

4. Apparatus according to claim 3 further including a discharge conveyor which is adapted to cooperate with said main support platform so that said main support platform can move to positions above and below said discharge conveyor without interference and when said support platform is moved from a position above to a position below said conveyor, said at least one layer of timber is transferred from said main support platform to said discharge conveyor for displacement from the bottom of the timber stack.

5. Apparatus according to claim 4 including spacing means positioned between the new layer and the penultimate layer of timber as they are periodically fed to the upper end of the kiln.

6. Apparatus according to claim 3 wherein said main support platform is vertically displaced by jacks.

7. Apparatus according to claim 3 wherein said temporary support mechanism includes a plurality of tynes which are arranged when in said operative position to extend between adjacent spacers between adjacent timber layers.

8. Apparatus according to claim 1 wherein the means to direct heated air comprises at least one fan coupled to ducting, the ducting being arranged to direct air through the layers of timber.

9. Apparatus according to claim 8 wherein the ducting is designed to reverse the direction of the stream of hot air so that as the layers of timber pass from the top to the bottom of the apparatus, the timber is sequentially subjected to currents of hot air from opposed directions.

10. A method of drying timber comprising the steps of: forming a substantially vertical stack of timber comprising a plurality of layers of timber stacked one on top of the other and spaced apart by spacer means; sequentially feed at least one layer of timber to the top of the stack and discharging at least one layer of timber from the bottom of the stack so that the layers of timber move from the top to the bottom of the stack; passing the layers of timber through a drying zone in which the layers are subjected to currents of heated air which are directed in reverse streams over the timber layers; cooling the layers of timber after leaving said drying zone; passing the layers of timber to a conditioning zone in which they are subjected to a humid air/water vapour mixture; passing the layers of timber to an ejection zone after leaving the conditioning zone; and ejecting the layers in a predetermined manner from the bottom of the stack.

11. The method of claim 10 further comprising the step of feeding the layers of timber to a pretreatment zone prior to passing to said drying zone, said pretreatment zone being adapted to receive a plurality of timber layers therein at the same time.

12. A method of drying pieces of timber comprising: forming a substantially vertical stack of timber by arranging the timber pieces in a plurality of layers each of which includes a plurality of horizontal pieces of timber and arranging spacer means between the layers to space the layers vertically apart; periodically feeding at least one layer of timber to the top of the stack and periodically discharging at least one layer of timber from the bottom of the stack so that each layer moves downwardly periodically so as to move from a position at the top of the stack to a position at the bottom of the stack; drying the timber by passing heated drying air horizontally through a vertical portion of the stack in one direction and in a reverse direction at a different elevation in said portion whereby the layers of timber are exposed to drying air as they move downwardly through said vertical portion; cooling the downwardly moving layers of timber after the layers leave said vertical portion; and subjecting the downwardly moving layers of timber to a humid air/water vapor mixture after the layers have been cooled.

* * * * *